US009887480B2

(12) United States Patent
Tanaka et al.

(10) Patent No.: US 9,887,480 B2
(45) Date of Patent: Feb. 6, 2018

(54) CONTACT INCLUDING DEFORMATION PREVENTER FOR PREVENTING DEFORMATION OF CONNECTOR SUPPORT

(71) Applicant: FUJITSU COMPONENT LIMITED, Tokyo (JP)

(72) Inventors: Tetsugaku Tanaka, Tokyo (JP); Yasuyuki Miki, Tokyo (JP); Koki Sato, Tokyo (JP); Mitsuru Kobayashi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/806,845

(22) Filed: Jul. 23, 2015

(65) Prior Publication Data

US 2016/0056546 A1 Feb. 25, 2016

(30) Foreign Application Priority Data

Aug. 20, 2014 (JP) ..... 2014-167893

(51) Int. Cl.

| | |
|---|---|
| ***H01R 12/00*** | (2006.01) |
| ***H01R 13/24*** | (2006.01) |
| *H01R 12/57* | (2011.01) |
| *H01R 12/71* | (2011.01) |
| *H01R 12/73* | (2011.01) |

(52) U.S. Cl.

CPC ..... *H01R 13/2442* (2013.01); *H01R 12/57* (2013.01); *H01R 12/714* (2013.01); *H01R 12/73* (2013.01)

(58) Field of Classification Search

CPC ..... H01R 23/722; H01R 13/2414; H01R 13/2442; H01R 13/193; H01R 13/41; H05K 7/1069

USPC ..... 439/66, 71, 91, 591, 862, 342, 733.1

See application file for complete search history.

(56) References Cited

U.S. PATENT DOCUMENTS

| | | | | |
|---|---|---|---|---|
| 4,813,881 | A * | 3/1989 | Kirby | H01R 13/111 439/381 |
| 5,573,435 | A * | 11/1996 | Grabbe | H01R 12/714 439/66 |
| 5,997,315 | A * | 12/1999 | Akama | H01R 13/2442 439/326 |
| 6,176,737 | B1 * | 1/2001 | Choy | H01R 13/6456 439/541.5 |
| 6,293,833 | B1 * | 9/2001 | Kamath | H01R 13/113 439/839 |
| 6,299,458 | B1 * | 10/2001 | Yamagami | H01R 13/2435 439/266 |
| 6,471,534 | B1 * | 10/2002 | Lee | H01R 13/193 439/342 |
| 6,551,149 | B2 * | 4/2003 | Orihara | H01R 13/2442 439/83 |

(Continued)

FOREIGN PATENT DOCUMENTS

JP 2002-015801 1/2002

*Primary Examiner* — Thanh Tam Le

(74) *Attorney, Agent, or Firm* — IPUSA, PLLC

(57) ABSTRACT

A contact for connecting a first object and a second object. The contact includes a base to be connected to the first object, a connector to be brought into contact with the second object, a support that supports the connector such that the connector is disposed away from the base, and a deformation preventer that prevents deformation of the support.

2 Claims, 8 Drawing Sheets

(56) References Cited

U.S. PATENT DOCUMENTS 6,824,396 B2 * 11/2004 Koopman ..... H01R 13/2435 439/71
6,843,659 B2 * 1/2005 Liao ..... H01R 13/2435 439/66
7,052,284 B2 * 5/2006 Liao ..... H01R 13/2435 439/66
7,090,504 B2 * 8/2006 Hou ..... H01R 13/2435 439/515
7,150,632 B2 * 12/2006 Lee ..... H01R 13/2435 439/66
7,303,421 B2 * 12/2007 Liao ..... H01R 4/02 439/342
7,341,485 B2 * 3/2008 Polnyi ..... H01R 13/2435 439/591
7,429,200 B2 * 9/2008 Lee ..... H01R 13/2442 439/862
7,445,518 B2 * 11/2008 Schneider nee Hild ..... H01R 13/2428 439/700
7,556,543 B2 * 7/2009 Weber ..... H01R 4/2454 439/857
7,682,165 B2 * 3/2010 Liao ..... H05K 3/3426 439/342
7,727,032 B2 * 6/2010 Szu ..... H01R 12/57 439/342
7,938,647 B2 * 5/2011 Zheng ..... H01R 12/714 439/66
7,989,045 B2 * 8/2011 Chang ..... H01R 12/57 174/366
8,052,428 B2 * 11/2011 Tsao ..... H01R 4/4809 439/66
8,123,574 B2 * 2/2012 Ma ..... H01R 13/2442 439/862
8,167,664 B2 * 5/2012 Ju ..... H01R 13/11 439/733.1
8,177,561 B2 * 5/2012 Ouchi ..... H01R 13/2485 174/260
8,449,334 B2 * 5/2013 Wang ..... H01R 12/73 439/630
8,475,180 B2 * 7/2013 Yumi ..... H01R 12/57 439/591
8,758,068 B2 * 6/2014 Wang ..... H01R 4/02 439/816
9,088,084 B2 * 7/2015 Liao ..... H01R 13/41
9,431,731 B2 * 8/2016 Oba ..... H01R 11/18

* cited by examiner

CONTACT INCLUDING DEFORMATION PREVENTER FOR PREVENTING DEFORMATION OF CONNECTOR SUPPORT

CROSS-REFERENCE TO RELATED APPLICATION

The present application is based upon and claims the benefit of priority of Japanese Patent Application No. 2014-167893, filed on Aug. 20, 2014, the entire contents of which are incorporated herein by reference.

BACKGROUND OF THE INVENTION

1. Field of the Invention

An aspect of this disclosure relates to a contact.

2. Description of the Related Art

In an electronic apparatus, boards facing each other at a distance may be electrically connected to a chassis frame of the electronic apparatus, or a pair of boards facing each other at a distance may be electrically connected to each other for frame grounding. Japanese Laid-Open Patent Publication No. 2002-015801, for example, discloses electrically connecting a pair of boards, which face each other at a distance, by using a contact.

When the distance between the pair of boards changes, the contact may be excessively pressed by the boards and deformed. When the contact is deformed, a contact point of the contact may be disengaged from an electrode pad provided on the board, and the connection between the board and the contact may be lost.

SUMMARY OF THE INVENTION

In an aspect of this disclosure, there is provided a contact for connecting a first object and a second object. The contact includes a base to be connected to the first object, a connector to be brought into contact with the second object, a support that supports the connector such that the connector is disposed away from the base, and a deformation preventer that prevents deformation of the support.

DESCRIPTION OF EMBODIMENTS

Embodiments of the present invention are described below with reference to the accompanying drawings.

Throughout the accompanying drawings, the same or corresponding reference numbers are assigned to the same or corresponding components, and repeated descriptions of those components are omitted. Unless otherwise mentioned, the drawings do not indicate relative sizes of components. A person skilled in the art may determine actual sizes of components taking into account the embodiments described below.

The embodiments described below are examples, and the present invention is not limited to those embodiments. Not all of the features and their combinations described in the embodiments may be essential to the present invention.

FIGS. 1 through 5B are drawings illustrating a contact 1 according to an embodiment. As exemplified by FIG. 3, the contact 1 is disposed between a board 100 and a board 101 that are arranged to face each other at a distance, and electrically connects the boards 100 and 101.

For example, each of the boards 100 and 101 may be a printed-circuit board provided in an electronic apparatus, or a chassis frame of an electronic apparatus.

Figure 1:
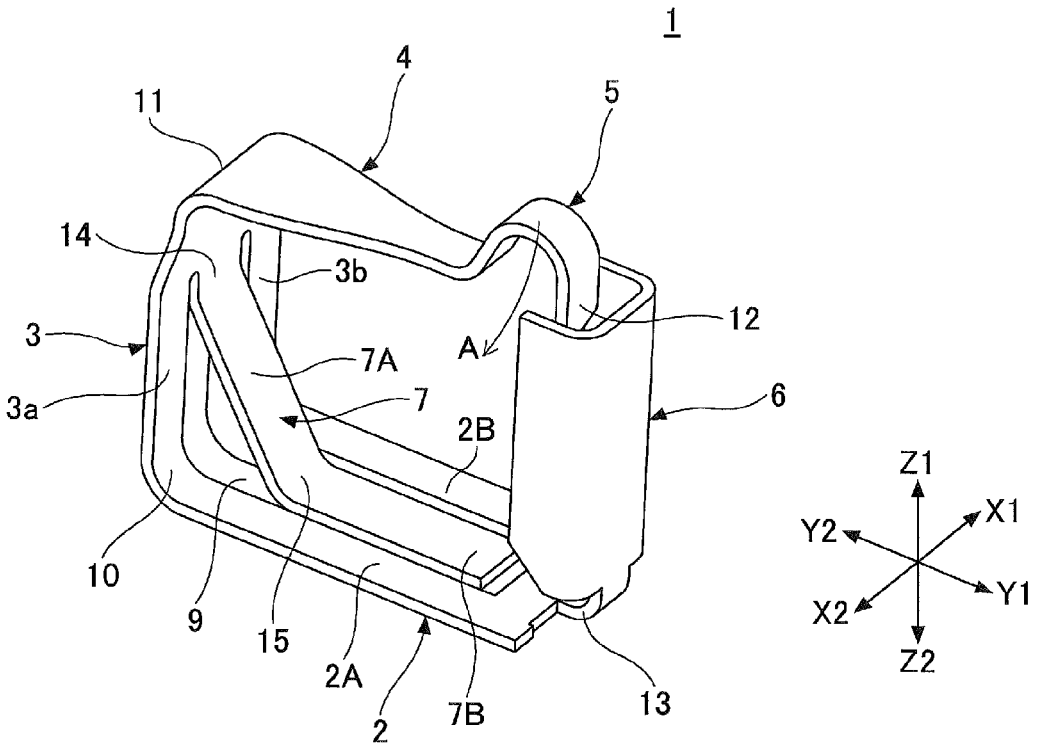
FIG. 1 is a perspective view of a contact.
Figure 2D:
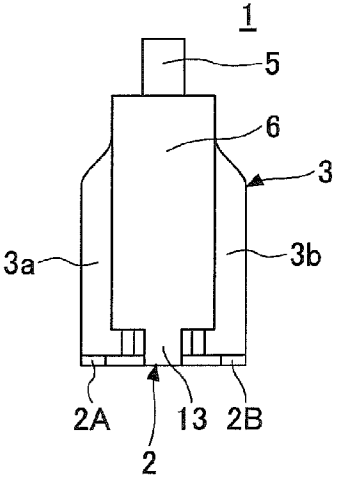
FIGS. 2A through 2E are a plan view, a left-side view, a front view, a right-side view, and a bottom view of a contact.
Figure 2A:
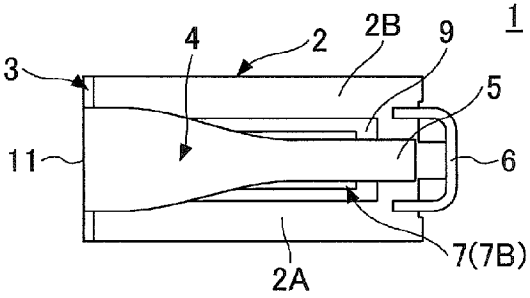
Figure 2C:
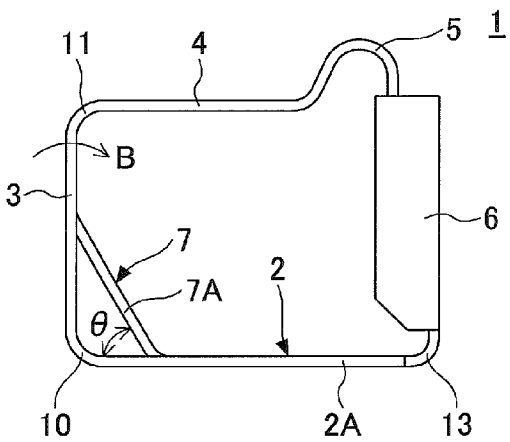
Figure 2E:
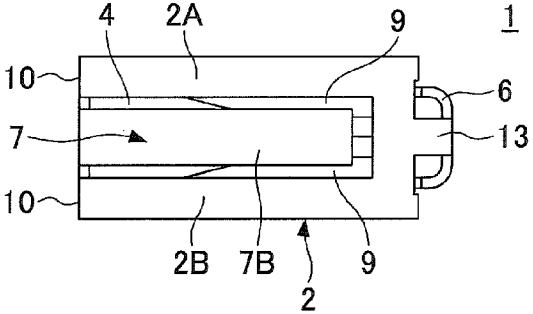
Figure 2B:
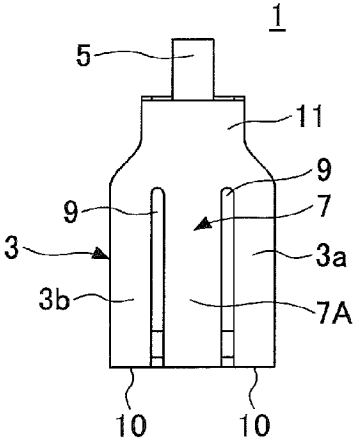

As illustrated by FIGS. 1 through 2E, the contact 1 includes a base 2, a support 3, a connector 4, a protector 6, and a deformation preventer 7. When the contact 1 is formed by pressing a flat metal plate, the base 2, the support 3, the connector 4, the protector 6, and the deformation preventer 7 are formed as a monolithic structure.

In the figures, an X1/X2 direction is the width direction of the contact 1, a Y1/Y2 direction is the longitudinal direction in which the base 2 extends, and a Z1/Z2 direction is a direction that is orthogonal to the plane direction of the base 2. The X1/X2, Y1/Y2, and Z1/Z2 directions are orthogonal to each other. Also, in the descriptions below, the Y1/Y2 direction may be referred to as a horizontal direction, and the Z1/Z2 direction may be referred to as a vertical direction. Further, the Y1/Y2 direction may be referred to as a Y-direction.

The contact 1 may be comprised of a conductive and elastic metal plate including, for example, phosphor bronze, beryllium copper, or stainless steel (SUS). Also, the whole or a part of a surface of the contact 1 may be plated with, for example, nickel, copper, or gold.

The contact 1 is fixed to one of the boards 100 and 101. For example, the contact 1 is fixed by soldering the base 2 to one of the boards 100 and 101. In the descriptions below, it is assumed that the base 2 is fixed to the board 100.

An electrode pad 102 is provided on a surface of the board 101. An electrode pad (not shown) is also provided on a surface of the board 100. The base 2 is connected to the electrode pad on the board 100 by soldering the base 2 to the board 100.

The base 2 is bent at a bent part 10 to form the support 3. The angle between the base 2 and the support 3 (or the bending angle of the bent part 10) is, for example, 90 degrees, and the support 3 rises in substantially the vertical direction from the base 2. The bending angle of the bent part 10 is not necessarily limited to 90 degrees.

The support 3 is bent at a bent part 11 to form the connector 4. The angle between the connector 4 and the support 3 (or the bending angle of the bent part 11) is, for example, 90 degrees. Because the support 3 rises from the base 2, the connector 4 is supported by the support 3 such that the connector 4 is disposed away from the base 2.

With the bending angle of the bent part 11 set at 90 degrees, the base 2 and the connector 4 are positioned substantially parallel to each other The distance between the base 2 and the connector 4 positioned parallel to each other becomes substantially equal to the length of the support 3 in the Z1/Z2 direction. The bending angle of the bent part 11 is not necessarily limited to 90 degrees.

An end of the connector 4, which is opposite from the bent part 11, is a free end. Thus, the connector 4 is formed as a cantilever that functions as a spring.

Figure 3:
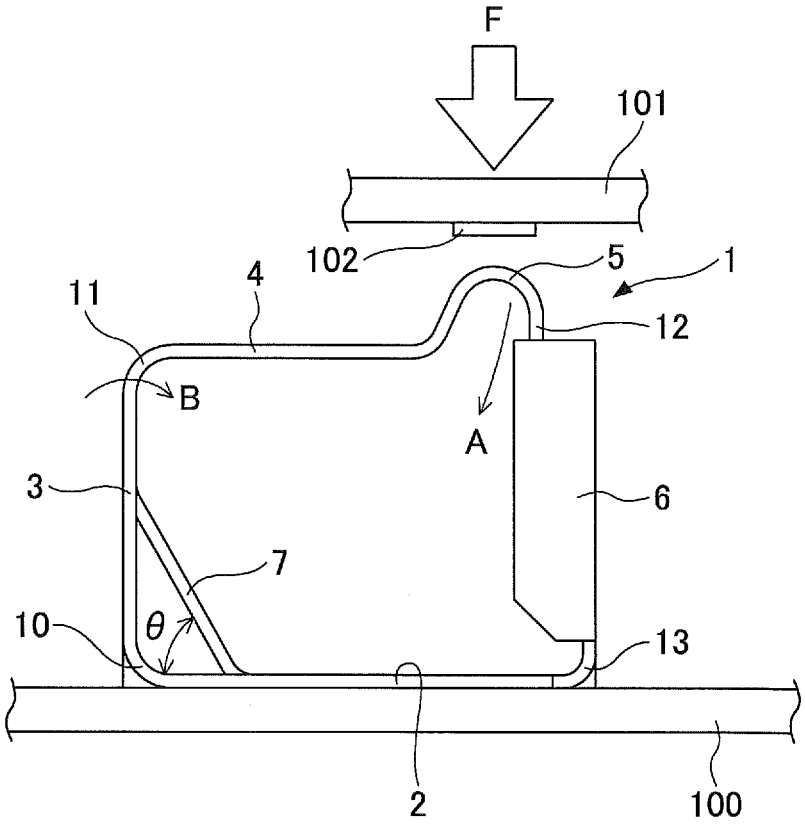
FIG. 3 is a drawing illustrating a contact disposed between boards.

A contact point 5 is formed at the end (free end) of the connector 4. The contact point 5 is formed by bending the end of the connector 4 into a substantially U-shape. As illustrated in FIG. 3, the contact point 5 is to be brought into contact and electrically connected with the electrode pad 102 formed on the board 101.

When the contact 1 is placed between the boards 100 and 101, the contact point 5 is pressed by the board 101 (an arrow F in FIG. 3 indicates the pressing force). With the pressing force F, the connector 4 is elastically deformed, and the contact point 5 is displaced in a direction indicated by an arrow A in FIGS. 1 and 3.

When the connector 4 is deformed, an elastic restoring force (hereafter simply referred to as a "restoring force") is generated in the connector 4. Due to the restoring force, the contact point 5 is biased toward and pressed against the electrode pad 102.

The protector 6 protects the contact point 5. The protector 6 is formed at an end (the Y1 end) of the base 2 which is opposite from an end at which the bent part 10 is formed. The protector 6 is connected to the base 2 via a bent part 13. The bending angle of the bent part 13 is, for example, about 90 degrees.

The protector 6 covers the contact point 5 over a range of displacement of the contact part 5. The protector 6 prevents an external force from being applied to the contact point 5 when, for example, the contact 1 is placed between the boards 100 and 101. The bending angle of the bent part 13 is not necessarily limited to 90 degrees as long as the protector 6 can protect the contact point 5.

Next, the deformation preventer 7 is described.

The deformation preventer 7 prevents deformation of the support 3. The deformation preventer 7 may be provided in or near the support 3.

The deformation preventer 7 is formed, for example, by pressing and punching out a central portion of the base 2 and the support 3 except for a part connected to the support 3, and by bending the punched-out portion at a bent part 14 such that the punched-out portion extends from the support 3 linearly and obliquely downward toward the base 2. That is, the deformation preventer 7 is inclined with respect to the support 3.

The deformation preventer 7 includes an inclined part 7A and a fixed part 7B that are formed as a monolithic structure. An upper end of the inclined part 7A is bent at the bent part 14 from the support 3. Thus, the support 3 and the inclined part 7A are seamlessly connected to each other. In the descriptions below, an angle θ of the deformation preventer 7 with the base 2 may be referred to as an "inclination angle θ".

A lower end of the inclined part 7A is bent at a bent part 15 to form the fixed part 7B. The fixed part 7B is disposed to be in substantially the same plane with the base 2. The fixed part 7B is soldered to the board 100 together with the base 2.

As described above, when the contact 1 is mounted on the board 100, the base 2 is soldered to the board 100. When the base 2 is soldered, the fixed part 7B of the deformation preventer 7 is also soldered and fixed to the board 100.

With the fixed part 7B fixed to the board 100 by soldering, the deformation preventer 7 functions as a prop for supporting the support 3. That is, even when a force is applied to cause the support 3 to be displaced around the bent part 10 and fall in a direction indicated by an arrow B in FIG. 2C and FIG. 3, the deformation preventer 7, with the fixed part 7B fixed to the board 100, supports the support 3 and prevents deformation of the support 3.

The inclination angle θ of the deformation preventer 7 with the base 2 may be set at, but is not limited to, 60 degrees.

Next, operation of the contact 1 is described with reference to FIG. 4.

Figure 4:
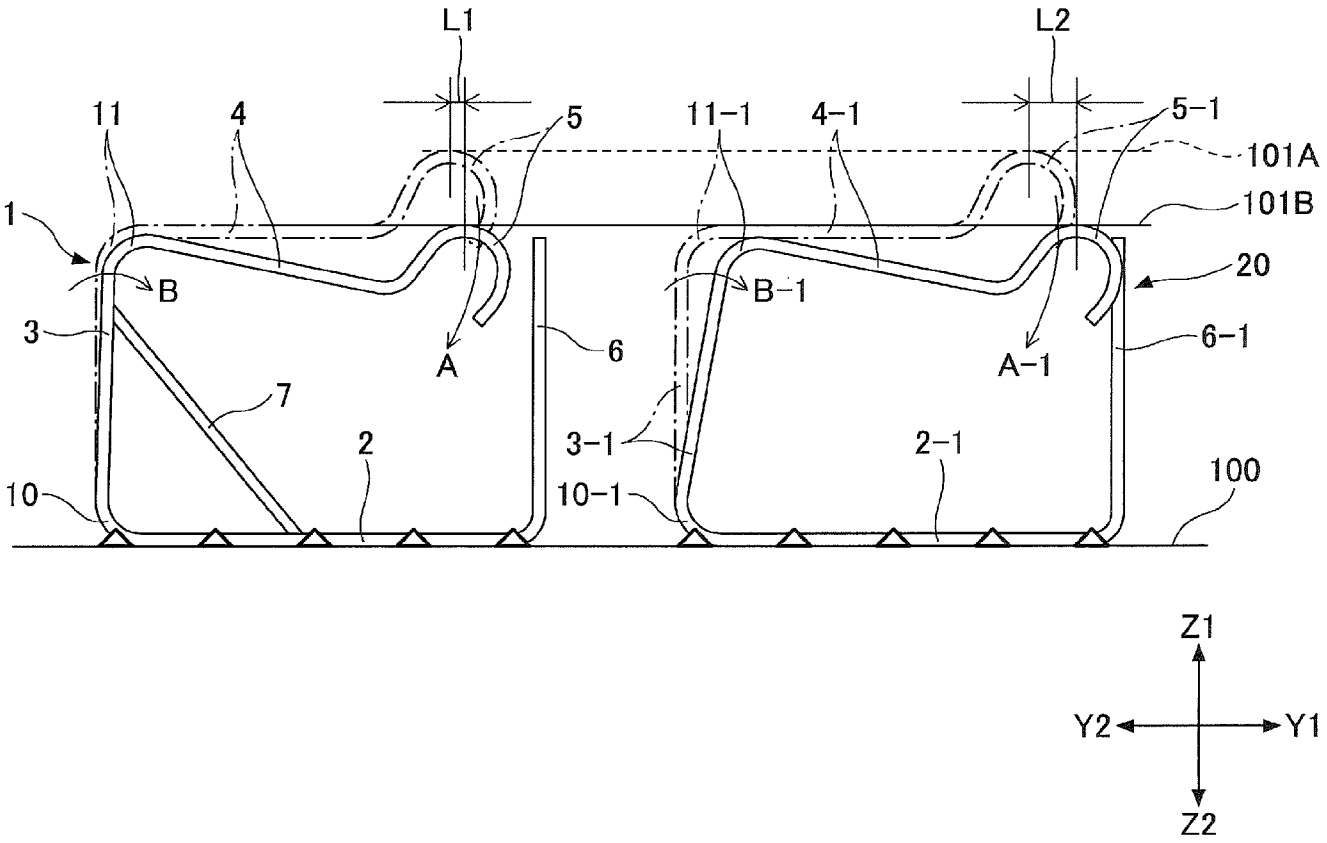
FIG. 4 is a drawing illustrating a contact of an embodiment and a contact of a comparative example.

The left side of FIG. 4 illustrates operation of the contact 1 when the contact 1 is mounted on the board 100 and pressed by the board 101. The right side of FIG. 4 illustrates operation of a contact 20 of a comparative example when the contact 20 is mounted on the board 100 and pressed by the board 101. The contact 20 does not include the deformation preventer 7.

Except that the contact 20 does not include the deformation preventer 7, the contact 1 and the contact 20 have substantially the same configuration. Therefore, reference numbers of components of the contact 20 are expressed by adding "−1" to the reference numbers of the corresponding components of the contact 1.

In FIG. 4, a dotted line 101A indicates a position of the board 101 before the board 101 contacts the contact point 5/5-1. In the descriptions below, a state of each of the contacts 1 and 20 before the board 101 contacts the contact point 5/5-1 may be referred to as a "pre-pressed state".

Also in FIG. 4, a solid line 101B indicates a position of the board 101 at which the board 101 presses the contact point 5/5-1. In the descriptions below, a state of each of the contacts 1 and 20 when the board 101 is pressing the contact point 5/5-1 may be referred to as a "pressed state".

In the pre-pressed state, each of the contacts 1 and 20 is not deformed. Accordingly, the support 3, the connector 4, and the protector 6 of the contact 1 are substantially in the same shapes as the support 3-1, the connector 4-1, and the protector 6-1 of the contact 20 (indicated by dashed-dotted lines in FIG. 4).

When the board 101 moves toward the board 100 (in the Z2 direction), the board 101 contacts the contact point 5/5-1, and presses the contact point 5/5-1 toward the board 100.

Because the connector 4/4-1 has a cantilever structure and has elasticity, when the contact point 5/5-1 is pressed by the board 100, the connector 4/4-1 elastically deforms and is displaced around the bent part 11/11-1 toward the base 2/2-1. That is, in FIG. 4, the connector 4/4-1 is displaced around the bent part 11/11-1 in a direction indicated by an arrow A/A-1.

Because the connector 4/4-1 is seamlessly connected to the support 3/3-1 at the bent part 11/11-1, when the contact point 5/5-1 is pressed by the board 101 and the connector 4/4-1 is displaced, the support 3/3-1 is also displaced around the bent part 10/10-1 toward the base 2/2-1 and is inclined in a direction indicated by an arrow B/B-1. In the descriptions below, the displacement or the inclination of the support 3/3-1 in the direction of the arrow B/B-1, which is caused when the board 101 presses the contact point 5/5-1, may be referred to as a "forward fall" and may be expressed as "fall forward".

Next, operation of the contact 20 not including the deformation preventer 7 is described.

When the contact point 5-1 is pressed by the board 101, because the contact 20 does not include the deformation preventer 7 for limiting deformation of the support 3-1, the support 3-1 of the contact 20 falls forward.

As illustrated in FIG. 3, the contact point 5 is electrically connected to the electrode pad 102 on the board 101. However, with the contact 20 that does not include the deformation preventer 7, the contact point 5-1 is greatly displaced in the Y-direction due to the forward fall and may be disengaged from the electrode pad 102. When the contact point 5-1 is disengaged from the electrode pad 102, the electrical connection between the board 100 and the board 101 is lost.

Next, operation of the contact 1 including the deformation preventer 7 is described.

With the contact 1 including the deformation preventer 7, even when the contact point 5 is pressed by the board 101 and a force is applied to the support 3, the deformation preventer 7 supports the support 3 and prevents the support 3 from falling forward (in the direction of the arrow B). Also, because the forward fall of the support 3 is prevented, the amount of displacement of the contact point 5 is reduced. For this reason, a displacement L1 of the contact point 5 of the contact 1 in the pressed state is less than a displacement L2 of the contact point 5-1 of the contact 20 not including the deformation preventer 7 (L1<L2).

The contact 1 including the deformation preventer 7 can reduce the amount of displacement of the contact point 5 in the Y-direction due to the pressure applied by the board 101, and improves the reliability of connection between the contact 1 and the board 101.

Also, as illustrated in the right side of FIG. 4, when the amount of displacement of the contact point 5-1 in the Y-direction is large, it is necessary to provide a space corresponding to the amount of displacement in the contact 20. This in turn increases the space occupied by the contact 20 on the board 100. On the other hand, the present embodiment can reduce the amount of displacement of the contact point 5 in the Y-direction and the space occupied by the contact 1 on the board 100.

The contact 1, including the deformation preventer 7, can be formed as a monolithic structure by pressing a single metal plate. Accordingly, providing the deformation preventer 7 does not increase the manufacturing costs of the contact 1.

Next, a contact according to another embodiment is described.

FIGS. 5A through 6E illustrate a contact 30 according to another embodiment. The same reference numbers as those in FIGS. 1 through 4 are assigned to the corresponding components in FIGS. 5A through 6E, and repeated descriptions of those components are omitted.

The contact 30 illustrated by FIGS. 5A through 6E includes a deformation preventer 37 having a step.

The deformation preventer 37 includes a platform 37A, a leg 37B, and a fixed part 37C that are formed as a monolithic structure.

The platform 37A is connected to the support 3 at a bent part 34. The platform 37A extends from the bent part 34 in a horizontal direction (in the Y1/Y2 direction). Accordingly, the platform 37A is substantially parallel to the base 2.

An end of the platform 37A opposite from the bent part 34 is bent at a bent part 35 to form an upper end of the leg 37B. The leg 37B extends downward (in the Z2 direction) from the bent part 35. Accordingly, the leg 37B is substantially perpendicular to the base 2.

A lower end of the leg 37B is bent at a bent part 36 to form the fixed part 37C. When the base 2 is soldered to the board 100, the bent part 36 is also soldered to the board 100.

Figure 5B:
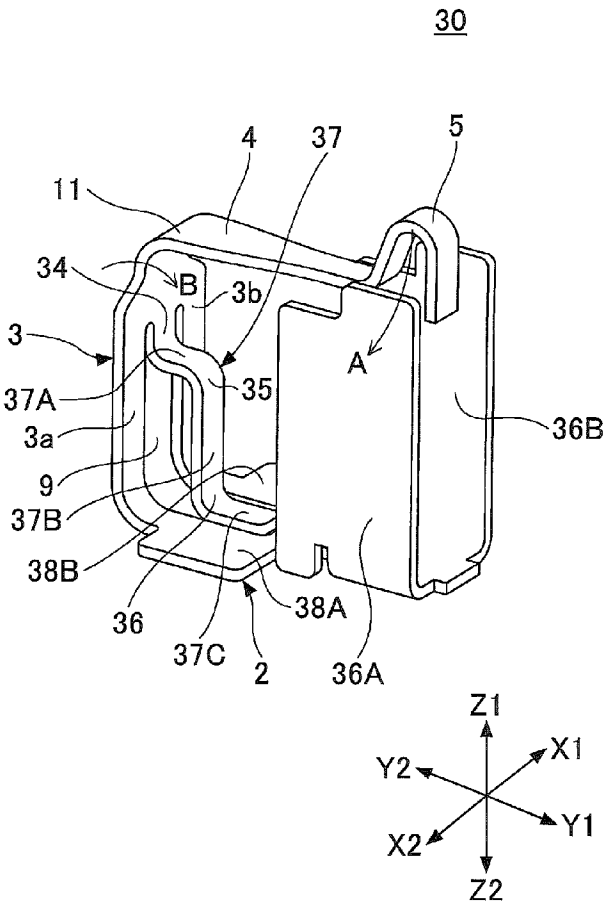
FIGS. 5A and 5B are a front perspective view and a rear perspective view of a contact.
Figure 5A:
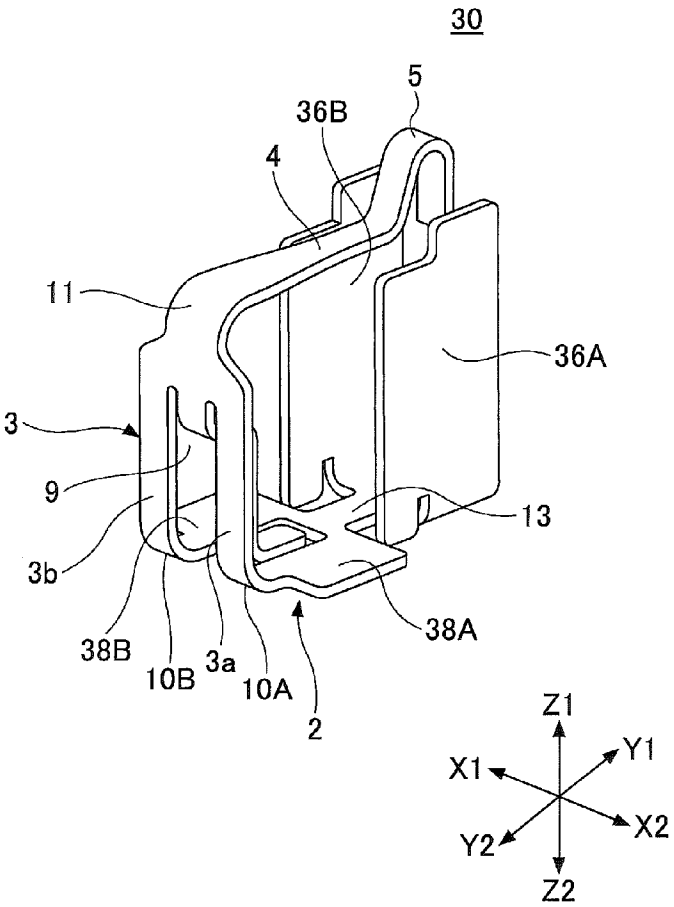
Figure 6A:
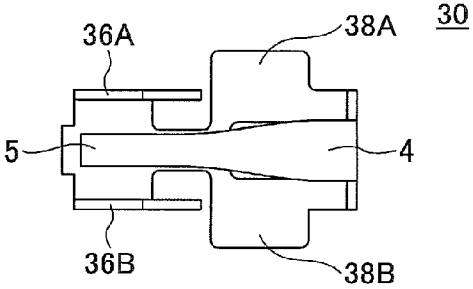
FIGS. 6A through 6E are a plan view, a left-side view, a front view, a right-side view, and a bottom view of a contact.
Figure 6C:
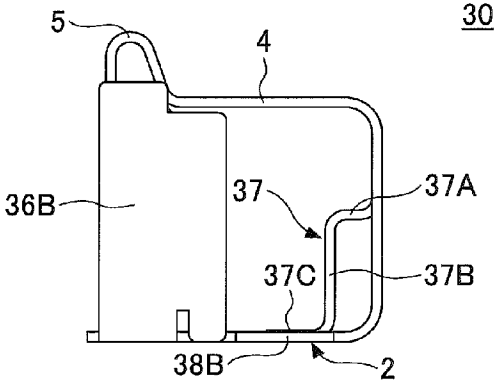
Figure 6E:
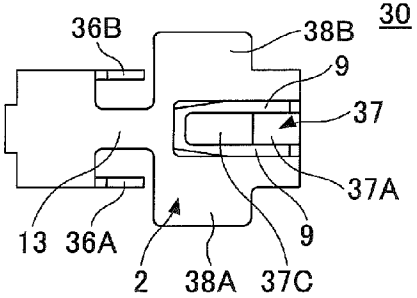
Figure 6D:
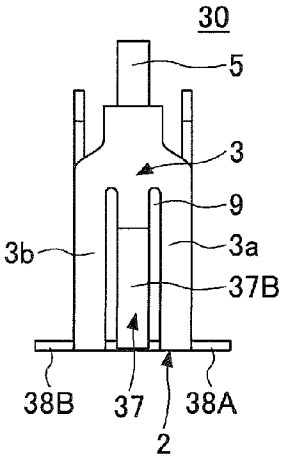
Figure 6B:
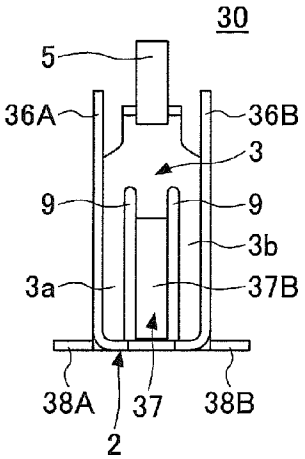

As illustrated in FIGS. 5A and 5B, the contact 30 includes extensions 38A and 38B extending in the width direction from the corresponding sides of the base 2 to increase an area to be soldered.

The deformation preventer 37 having a step can support the support 3 and prevent the support 3 from falling forward. Accordingly, the contact 30 of the present embodiment can reduce the amount of displacement of the contact point 5 in the Y-direction due to the pressure applied by the board 101, and can improve the reliability of electrical connection between the contact 30 and the board 101.

In the example of FIGS. 5A through 6E, one step is formed in the deformation preventer 37. However, the number of steps of the deformation preventer 37 is not limited to one, and two or more steps may be formed in the deformation preventer 37.

The contact 30 of FIGS. 5A through 6E also includes a pair of protectors 36A and 36B on the sides of the contact point 5 to protect the contact point 5. Each of the protectors 36A and 36B rises from an end of the base 2 which is opposite from an end at which the support 3 is formed, respectively.

Figure 7B:
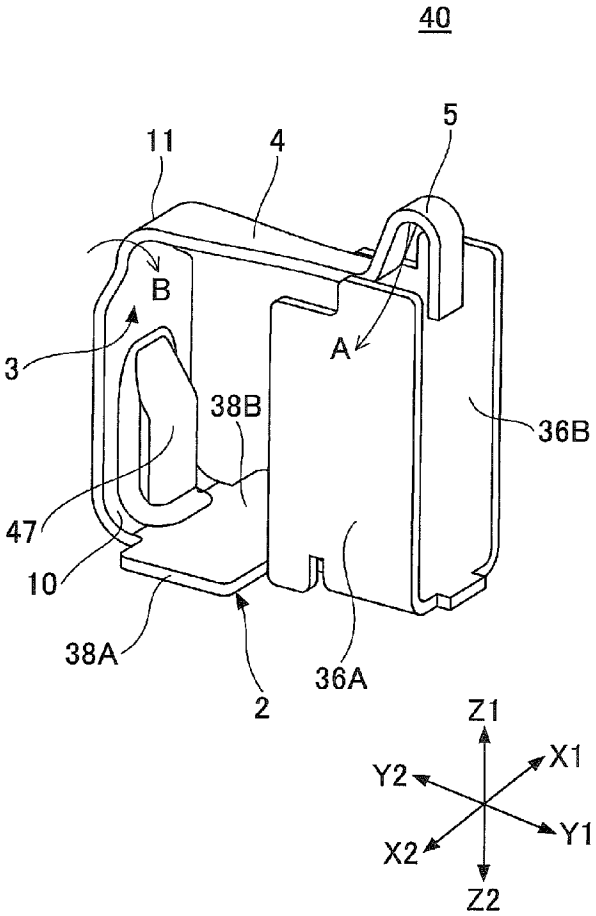
FIGS. 7A and 7B are a front perspective view and a rear perspective view of a contact.
Figure 7A:
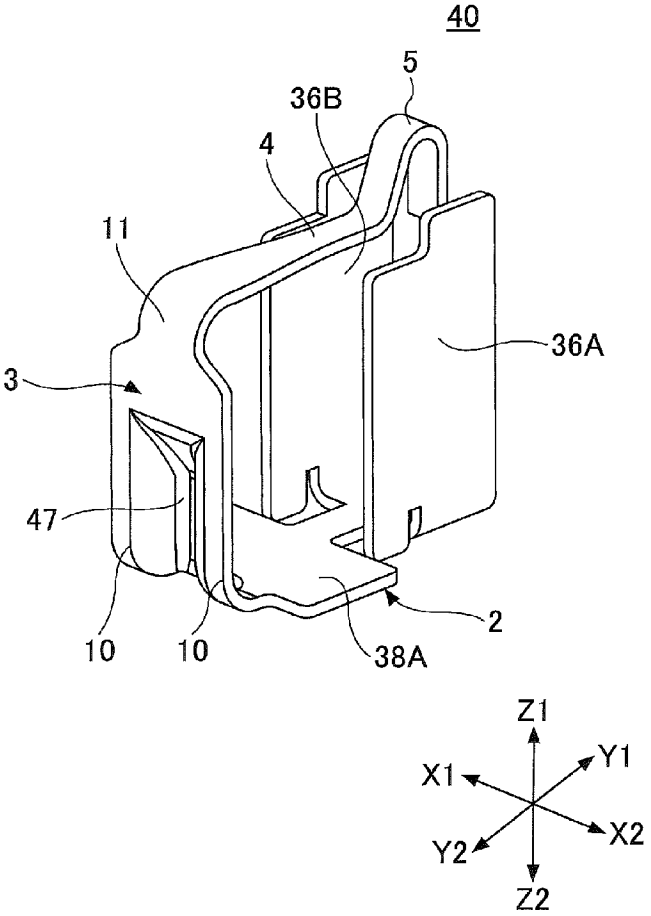

FIGS. 7A and 7B illustrate a contact 40 according to another embodiment.

The same reference numbers as those in FIGS. 1 through 6E are assigned to the corresponding components in FIGS. 7A and 7B, and repeated descriptions of those components are omitted.

The contact 40 includes a deformation preventer 47 that is formed by plastically deforming a part of the support 3. The deformation preventer 47 is a protrusion that is formed by deforming a part of the support 3 inward (in the Y1 direction).

For example, the deformation preventer 47 may be formed at the same time as the contact 40 is formed by pressing a metal plate. Thus, the deformation preventer 47 can be easily formed.

Forming the deformation preventer 47 in the support 3 has substantially the same effect as increasing the thickness of the support 3, and may increase the rigidity of the support 3. This in turn makes it possible to prevent the support 3 from being displaced toward the base 2 when the contact point 5 is pressed by the board 101.

The deformation preventer 47 is formed in the bent part 10 between the base 2 and the support 3. Forming a part of the deformation preventer 47 in the bent part 10 improves the rigidity of the bent part 10, and can prevent the support 3 from being displaced around the bent part 10.

Accordingly, the contact 40 of the present embodiment can reduce the amount of displacement of the connector 4 and the contact point 5 due to the pressure applied by the board 101, and the reliability of electrical connection between the contact 40 and the board 101 is improved.

In the present embodiment, the deformation preventer 47 is formed by plastically deforming the support 3 from the outside toward the inside, i.e., in the Y1 direction. Accordingly, the deformation preventer 47 protrudes inward from the support 3.

However, the direction in which the support 3 is deformed to form the deformation preventer 47 is not limited to the inward direction. For example, the deformation preventer 47 may be formed by deforming the support 3 in the outward direction (the Y2 direction).

Also, the deformation preventer 47 is not limited to one, and multiple deformation preventers 47 may be formed in the support 3. For example, although the deformation preventer 47 is also formed in the bent part 10 positioned below the support 3 in FIGS. 7A and 7B, the deformation preventer 47 may be formed in the bent part 11 above the support 3, or in each of the bent part 10 and the bent part 11.

Figure 8:
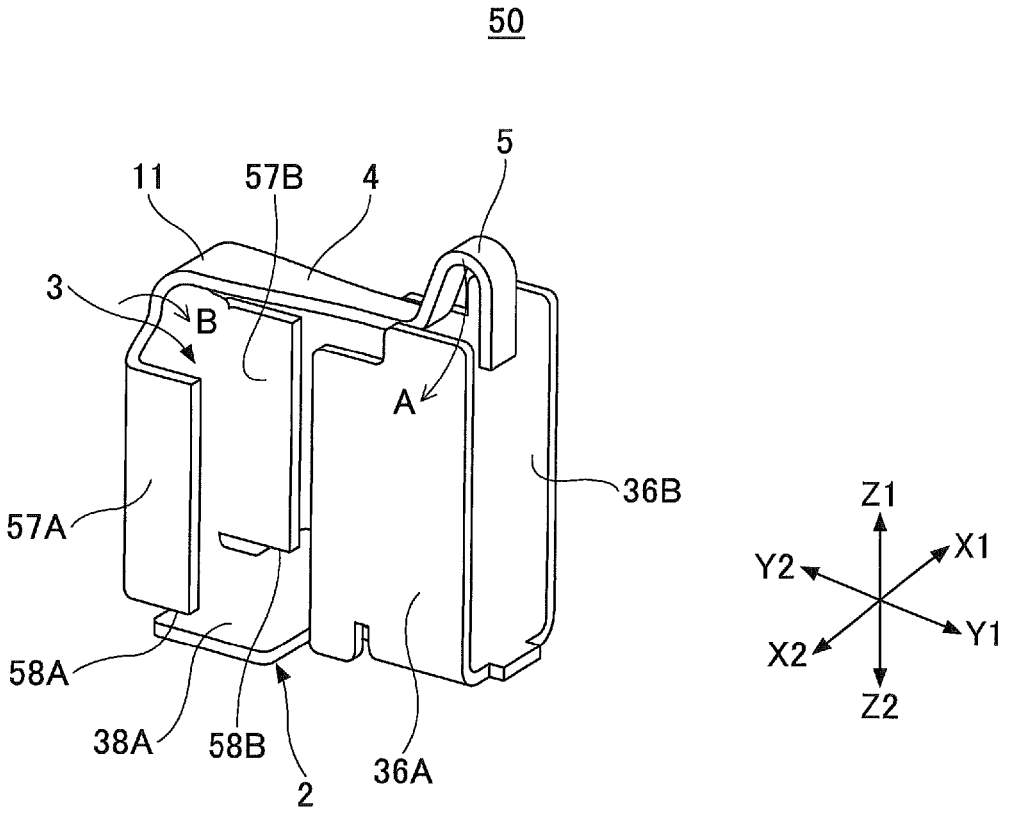
FIG. 8 is a front perspective view of a contact.

FIG. 8 illustrates a contact 50 according to still another embodiment.

The same reference numbers as those in FIGS. 1 through 7B are assigned to the corresponding components in FIG. 8, and repeated descriptions of those components are omitted.

The contact 50 includes deformation preventers 57A and 57B that are formed by bending (plastically deforming) side parts of the support 3 inward (in the Y1 direction). The deformation preventers 57A and 57B are configured such that their lower ends 58A and 58B are in contact with or brought into contact with the base 2. That is, the deformation preventers 57A and 57B may be configured such that the lower ends 58A and 58B are in contact with the base 2 or a gap is present between each of the lower ends 58A and 58B and the base 2.

For example, the deformation preventers 57A and 57B may be formed at the same time as the contact 50 is formed by pressing a metal plate. Accordingly, the deformation preventers 57A and 57B can be formed easily.

Even when a force is applied by the board 101 to cause the support 3 to fall in a direction indicated by the arrow B, because the lower ends 58A and 58B of the deformation preventers 57A and 57B contact with the base 2, deformation of the support 3 is prevented by the deformation preventers 57A and 57B.

Accordingly, the contact 50 of the present embodiment can reduce the amount of displacement of the connector 4 and the contact point 5 in the Y-direction due to the pressure applied by the board 101, and the reliability of electrical connection between the contact 50 and the board 101 is improved.

Contacts according to the embodiments of the present invention are described above. However, the present invention is not limited to the specifically disclosed embodiments, and variations and modifications may be made without departing from the scope of the present invention.

For example, although the fixed parts 7B and 37C of the deformation preventers 7 and 37 are fixed by soldering to the board 100 in the above embodiments, the fixed parts 7B and 37C may not necessarily be fixed to the board 100. Instead, the fixed parts 7B and 37C may be fixed to the base 2.

What is claimed is:

1. A contact for connecting a first object and a second object, the contact comprising:

a base to be connected to the first object;

a support that extends vertically from an end of the base in a direction perpendicular to a direction in which the base extends;

a connector that extends from an end of the support and is to be brought into contact with the second object, the connector including a first end connected to the end of the support and a second end that is opposite the first end; and a deformation preventer that prevents the support from falling toward the base and being deformed, wherein one end of the deformation preventer is connected to the support, and another end of the deformation preventer is connected to one of the base and the first object;

the connector includes a contact point formed at the second end and to be brought into contact with the second object, the connector being configured to be elastically deformed by a pressing force of the second object pressing the contact part; and the deformation preventer includes:

an inclined part that is connected to the support and inclined with respect to the support, and a fixed part that extends from an end of the inclined part, is disposed in a same plane as the base, and is to be connected to the first object.

2. A contact for connecting a first object and a second object, the contact comprising:

a base to be connected to the first object;

a support that extends vertically from an end of the base in a direction perpendicular to a direction in which the base extends;

a connector that extends from an end of the support and is to be brought into contact with the second object, the connector including a first end connected to the end of the support and a second end that is opposite the first end; and a deformation preventer that prevents the support from falling toward the base and being deformed, wherein one end of the deformation preventer is connected to the support, and another end of the deformation preventer is connected to one of the base and the first object;

the connector includes a contact point formed at the second end and to be brought into contact with the second object, the connector being configured to be elastically deformed by a pressing force of the second object pressing the contact part; and the deformation preventer includes:

a platform that is connected to the support and extends in parallel with the base, and a leg that extends downward from an end of the platform, and a fixed part that extends from an end of the leg, is disposed in a same plane as the base, and is to be connected to the first object.

* * * * *